United States Patent [19]

Price

[11] Patent Number: 4,586,744

[45] Date of Patent: May 6, 1986

[54] APPARATUS FOR LIFTING AND HANDLING AN OBJECT

[76] Inventor: Marvin L. Price, Rte. 1, Box 490, Mill Spring, N.C. 28756

[21] Appl. No.: 621,547

[22] Filed: Jun. 18, 1984

[51] Int. Cl.[4] ..... B66C 1/44

[52] U.S. Cl. ..... 294/92; 294/104

[58] Field of Search ..... 294/92, 91, 101, 104, 294/103, 111, 112, 96, 86.4, 102.1; 24/299, 298

[56] References Cited

U.S. PATENT DOCUMENTS

| | | | |
|---|---|---|---|
| 882,796 | 3/1908 | Pedigo | 294/90 |
| 910,062 | 1/1909 | Holmberg | 294/92 |
| 953,234 | 3/1910 | Roantree | 294/92 |
| 1,457,445 | 6/1923 | Marcum | 294/90 |
| 1,797,482 | 3/1931 | Prockish | 294/92 |
| 2,393,430 | 1/1946 | Thompson | 294/92 |
| 2,697,001 | 12/1954 | McGraw | 294/69 |
| 3,295,883 | 1/1967 | Dupuy et al. | 294/90 |
| 3,360,292 | 12/1967 | Trammell | 294/66 |
| 3,834,751 | 9/1974 | Brackin | 294/92 |
| 4,097,084 | 6/1978 | Russell | 294/104 |

*Primary Examiner*—James B. Marbert
*Attorney, Agent, or Firm*—Dority & Manning

[57] ABSTRACT

Apparatus for lifting and/or handling objects, preferably cylindrical objects such as pipe or the like. A first object engaging element has a first pair of arms pivotally secured to opposite sides of same. A second pair of arms are pivotally associated with said first pair of arms. A second object engaging element is pivotally secured between said second pair of arms intermediate the length of same for disposition on a side of said object opposite the first engagement element. A third object engagement is pivotally secured between said second pair of arms for disposition on a side of said object opposite said second object engagement element. An elongated lifting element is secured to the first object engaging element, and when lifting force is applied thereto, the first, second, and third engagement elements are brought into gripping engagement with the object. An elongated releasing element may also be associated with the object engagement elements for avoiding gripping engagement when desired.

12 Claims, 6 Drawing Figures

APPARATUS FOR LIFTING AND HANDLING AN OBJECT

BACKGROUND OF THE INVENTION

The present invention relates to an apparatus for lifting, lowering and/or handling an object, preferably an elongated cylindrical object such as pipe that is being lifted from or lowered into a well.

Heretofore, numerous devices and techniques have been utilized for the removal or installation of, water pipe, for example, as might be utilized in conjunction with a submersible pump in a well shaft. Quite frequently, a number of sections of pipe are involved such that the overall weight of the pipe chain, particularly when the lifting operation has just begun or the lowering operation is almost complete, becomes very significant. In fact, equipment for the removal or installation of such pipe chains, due to the extreme weight involved, and the fact that moisture and/or materials of construction of the pipe may present slippery surfaces, must be able to firmly grip the pipe surface and must also possess strength characteristics adequate to lift the overall pipe length and the pump. Quite bulky apparatus has thus heretofore been utilized for such purpose.

In similar fashion, in the drilling of oil wells, natural gas wells and the like, wherein lengths of pipe are secured to adjacent lengths and lowered in to the well, the same or similar problems exist. Again, numerous prior art attempts have been made to arrive at a successful means for raising or lowering such lengths of pipe. In both environs, as noted above, as well as others, not only is the surface of the pipe and the overall weight of the pipe chain important, further problems are generally encountered by virtue of the small size of the openings along which the pipe chain must move. A well for potable water, for example, may be 6 inches in diameter with a 1 inch pipe received therein. Such restrictive dimensions, of course, not only dictate a small size for the lifting apparatus but also for manipulation of same to ensure proper grip and/or release of the apparatus with respect to the pipe. When considered in light of the attendant strength requirements, the potential problems could be of major proportion.

The present invention represents a simple and efficient apparatus that is useful in deployment within restrictive dimensional situations for handling of water pipe, oil pipe, or the like within a well and is quite effective in providing a gripping action along the exterior pipe surfaces which will fail only due to structural failure of components of the apparatus. In fact, the apparatus of the present invention functions somewhat analogously to a Chinese handcuff toy in that the stronger the pull, the greater the gripping power. Quite oppositely, however, effective release of gripping power may be easily inplemented.

Known prior art for apparatus for engaging and lifting objects include U.S. Pat. Nos. 4,097,084 to Russell; 3,295,883 to G. Dupuy et al; 1,797,482 to F. E. Prockish; 882,796 to L. T. Pedigo; 1,457,445 to H. Marcum; 853,234 to J. G. Rountree; 2,697,001 to H. R. McGraw; 3,360,292 to D. M. Trammel; and 910,062 J. A. Holmberg. None of the above listed patents are believed to be anticipatory or suggestive of the apparatus of the present invention.

SUMMARY OF THE INVENTION

It is an object of the present invention to provide an improved apparatus that is capable of being received in a dimensionally restrictive shaft such as a well for the handling of lengths of pipe therein during removal, installation, or the like.

Yet another object of the present invention is to provide an improved apparatus that is capable of lifting and/or handling an enlongated object of any particular dimensional cross section.

Yet another object of the present invention is to provide an improved apparatus for the lifting or lowering of enlongated cylindrical objects, which apparatus is adapted for improved holding and release from the cylindrical object.

Generally speaking, the apparatus of the present invention for lifting or holding an object comprises a first object engaging means; second object engaging means operatively associated with said first object engaging means to reside on an opposite side of said object while being axially spaced apart from said first object engaging means; third object engaging means operatively associated with said second object engaging means to reside on a side of said object generally opposite and axially displaced therefrom; means secured to said first object engaging means for raising and lowering said apparatus whereby upon tensioning of said raising and lowering means, said first, second, and third object engaging means are biased into respective sides of said object to securely hold same so long as said raising and lowering means remains tensioned.

More specifically, the apparatus according to teachings of the present invention includes three hemi-cylindrical object engaging elements the inner surfaces of which are adapted to define a contour that is matingly receivable about at least a portion of the outer surface of an object to be engaged. The first of such hemi-cylindrical engaging means is associated with a pair of spaced apart arms, each of which is pivotally secured on opposite side of the engaging means. A second pair of arms are then pivotally secured to said first pair of arms adjacent an outer free end of same and extend generally axially with respect thereto. A second hemi-cylindrical object engaging means is pivotally secured between said second pair of arms intermediate the length of same for engagement with a side of said object opposite said first engagement means while being axially spaced therefrom. The third hemi-cylindrical object engaging means is received at an outer free end of said second pair of arms and is adapted for engagement with a spacially separate portion of said object on a like side of same as said first object engaging means. In a normal disposition, an angular relationship is established at the pivotal connection between the first and second pair of arms such that two of the object engaging means are located on one side of the object while the middle object engaging means, i.e., the second, resides on an opposite side of the object.

The first hemi-cylindrical object engaging means is provided with an eyelet to which a raising and lowering means is secured, normally a rope, cable, chain or the like, such that when the apparatus is received about an elongated cylindrical object such as the length of pipe, tension applied to the lifting cable causes all of said object engaging means to firmly engage their respective portions of the object for lifting and/or lowering of same. Such gripping action remains viable so long as tension remains on the lifting rope. A second elongated element such as a rope, cord, or the like, is utilized as a releasing means to overcome the gripping action of the object engaging elements whereby the apparatus may be moved along the length of the cylindrical object to a proper position for gripping engagement, for removal from the pipe or the like. The releasing means is secured to the first object engagement means, preferably at the same eyelet at which the lifting means is secured and extends downwardly, generally towards an outer edge of said third object engaging means where it passes through a further eyelet secured thereto and returns along an upward path through a second, laterally offset eyelet located on said first object engaging means to a point where same may be appropriately manipulated.

Insofar as apparatus according to the present invention is concerned, as mentioned above, the preferred hemi-cylindrical object engaging means have an internal arcuate appearace that is matingly receivable against a particular diameter pipe or other cylindrical object to be handled. It is well within the purview of the present invention, however, that the apparatus may be utilized for any particular geometrical shape so long as the inside surface of the object engaging means grippingly mates with the exterior surface of the object.

DESCRIPTION OF THE PREFERRED EMBODIMENTS

Figure 1:
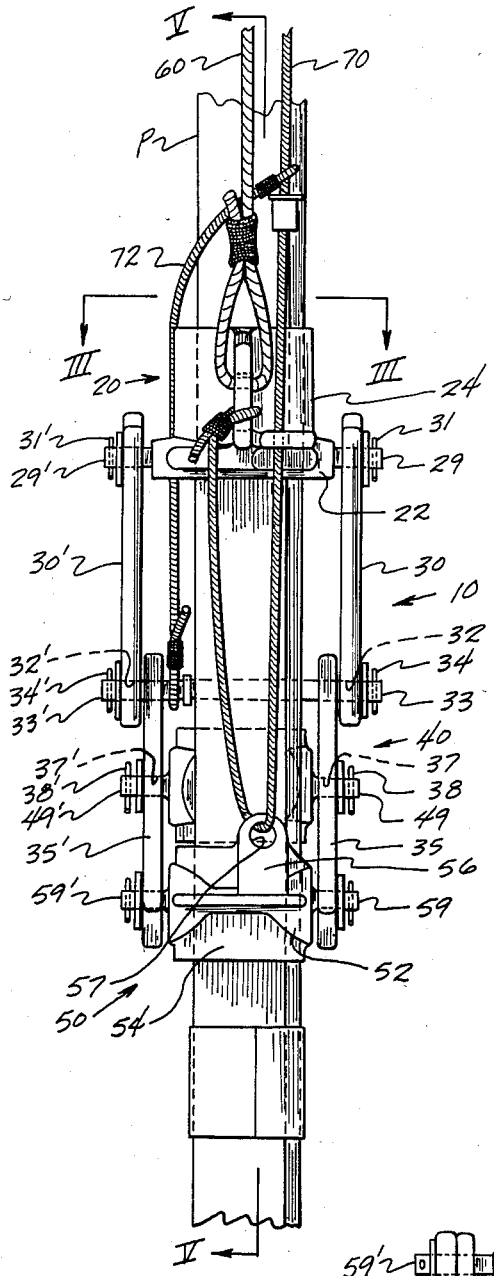
FIG. 1 is a frontal elevational view of an apparatus according to the present invention, illustrated about a length of pipe.
Figure 2:
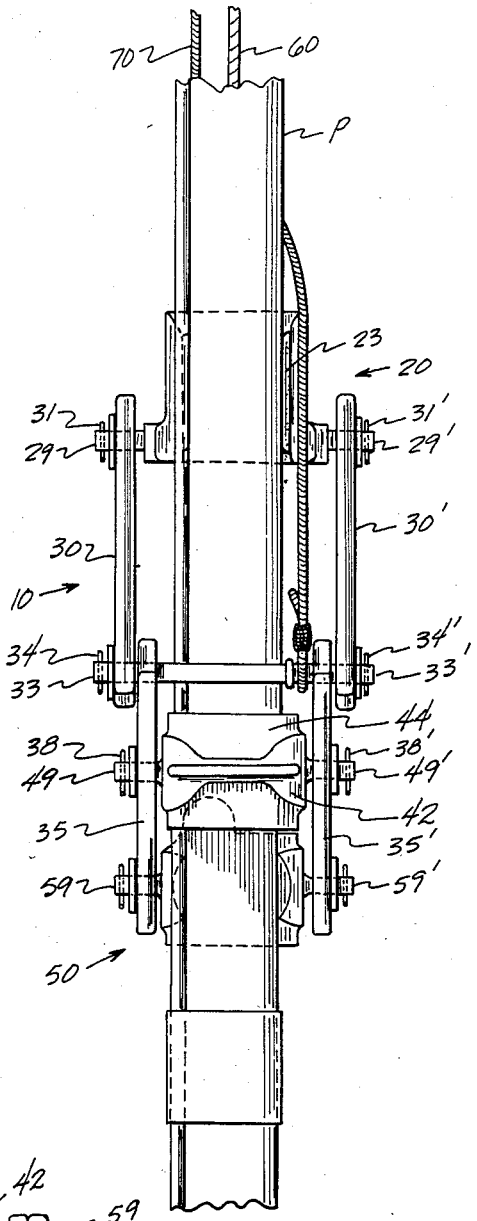
FIG. 2 is a rear elevational view of the apparatus as shown in FIG. 1.

Making reference to the Figures, preferred embodiments of the present invention will now be described in detail. The apparatus according to the present invention, as has been mentioned hereinbefore, finds utility as a device for use in the manipulation of various and sundry objects, with special emphasis on lengths of pipe, conduit, or the like, particularly while being handled in a restricted space such as within a well shaft.

The apparatus of the present invention, generally 10 includes a plurality of object engagement means generally 20, 40, and 50 that are interrelated in pivotal fashion with a first pair of arms 30, 30' and a second pair of arms 35, 35'. In such arrangement, object engagement means 20 and 50 will reside on one side of the object to be handled while engagement means 40 resides on an opposite side, and with all of such means making engagement with the object at axially spaced apart portions of same. In the Figures, the object is illustrated as a length of pipe P though other objects are capable of being handled by apparatus of the present invention as will be more particularly described hereinafter.

First object engaging means, generally 20, includes a body portion 22 with a flange section 24 secured thereto and extending outwardly therefrom. Flange section 24 has an inside wall 23 that generally conforms to an outside surface of the object with which the apparatus is being employed. Object engaging means 20 is further provided with a pair of structures 25 and 26' located along an outer surface of same, that define eyelets 25', 26' respectively therein. Eyelet structure 25 is axially aligned with respect to the apparatus, while eyelet structure 26 is transversely aligned with respect to the apparatus. As can further be seen, particularly in FIGS. 3 and 5, first object engaging means 20 may also have a high friction or other suitable gripping surface 28 secured along inside wall 23 of flange 24 to better ensure gripping engagement with pipe P. While in a preferred embodiment as illustrated in the Figures, both inside flange wall 23 and gripping surface 28 follow the outer contour of pipe P, obviously only the innermost surface which makes actual contact with the object need be so contoured. Further, inside wall 23 of flange 24 may have a particular surface configuration including corrugations, knurls, or the like that would be particularly adaptable for enhanced engagement with a particular object being handled. (See FIG. 6). First object engaging member 20 is further provided with connector rods 29, 29' that extend outwardly from opposite sides of body portion 22 to receive arms as described hereinafter.

Connector rods 29, 29' receive arms 30, 30' respectively of a first pair of arms thereabout, with the connector rods extending through appropriate openings in arms 30, 30'. Arms 30, 30' are thus freely pivotally connected about connector rods 29, 29' and are suitably secured thereon by cotter keys or the like 31, 31'. Opposite ends of arms 30, 30' are provided with appropriate openings 32, 32' through which a further connector rod 33 freely extends, with arms 30, 30' being pivotally secured thereabout by cotter keys or the like 34, 34'.

A second pair of arms 35, 35' are provided with appropriate openings 36, 36' adjacent an end of same with connector rod 33 extending therethrough. As is particularly illustrated in FIG. 1, second pair of arms 35, 35' are located within the first pair of arms 30, 30', about connector rod 33, with arms 35, 35' extending downwardly therefrom.

Figure 3:
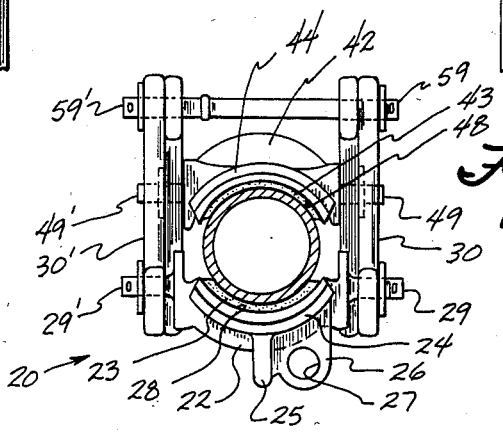
FIG. 3 is a top view of the apparatus as shown in FIG. 1.
Figure 4:
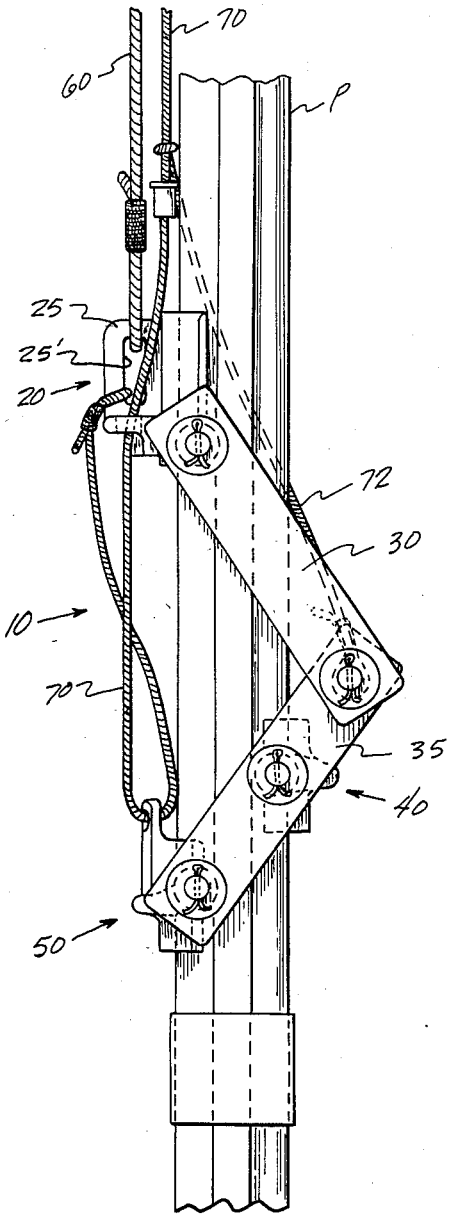
FIG. 4 is a side elevational view of the apparatus as shown in FIG. 1.

Located intermediate the length of second arms 35, 35', is a second object engagement means generally 40 which includes a body portion 42 having a flange 44 secured thereto and extending transversely outwardly therefrom. Like first object engaging means 20, second object engaging means 40 includes a flange inner wall 43 that generally conforms to the contour of the object to be handled. As shown in the Figures, inner wall 43 follows a generally hemi-cylindrical configuration, the radius of which would be predetermined, depending upon the size of the pipe to be lifted. As illustrated in FIG. 3, inside wall 43 of flange 44 is also provided with a gripping surface 48, though as mentioned above same may be configured as desired for the particular object being lifted. Second object engaging means 40 further has a pair of connector rods 49, 49' secured to body portion 42 that extend outwardly therefrom through appropriate openings 37, 37' of arms 35, 35'. Arms 35, 35' are appropriately pivotally secured about connector rods 49, 49' by cotter keys 38, 38' or the like.

Located at an outer free end of second pair of arms 35, 35' is a third object engaging means generally 50 which includes a body portion 52 having a flange 54 secured thereto and extending transversely outwardly therefrom in similar fashion to first and second object engaging means 20 and 40. An inside wall 53 of flange 54 is likewise provided with a gripping surface 58. Connector rods 59, 59' are also secured to body 52 and extend outwardly from opposite sides of same, passing through appropriate openings 39, 39' of arms 35, 35' respectively, for pivotal securement therebetween. Additionally, third object engaging means 50 has an structure 56 secured to body portion 52 that defines an eyelet 57. Eyelet structure 56 extends axially upwardly from body 52, generally parallel to flange section 54.

An elongated lifting means 60 such as a rope, wire, cable or the like, is secured through eyelet 25' of first object engaging means 20 and extends upwardly therefrom. Lifting means 60, in a well environment would extend to the surface where it would be secured to an appropriate take-up means, not shown and not a part of the present invention. With apparatus 10 secured about a pipe P, reeling in of the lifting means 60 by the take up means will apply to tension thereto such that appropriate gripping of the pipe P is achieved by engagement means 20, 40, and 50 and pipe P will be lifted. Application of appropriate force on lifting means 60, as can particularly be seen in FIG. 5, creates an upward force on object engaging means 20, which force causes arms 30, 30' to pivot about connector rods 29, 29' and about connector rod 33 at an opposite end of same, whereby arms 35, 35' likewise pivot about connector rod 33. Arms 30, 30' and 35, 35' thus receive forces which attempt to straighten the arms and thus forces the object engaging members 40 and 50 into gripping engagement with pipe P. Hence, a generally upwardly directed vector force on first pair of arms 30, 30' creates a generally transversely directed vector force on a second pair of arms 35, 35' about connector rod 33 which in turn transmits transverse forces through object engaging means 40 and 50 against pipe P, ensuring a proper gripping action. So long as the upward force remains on lifting element 60 the above noted forces maintain the gripping action.

Figure 5:
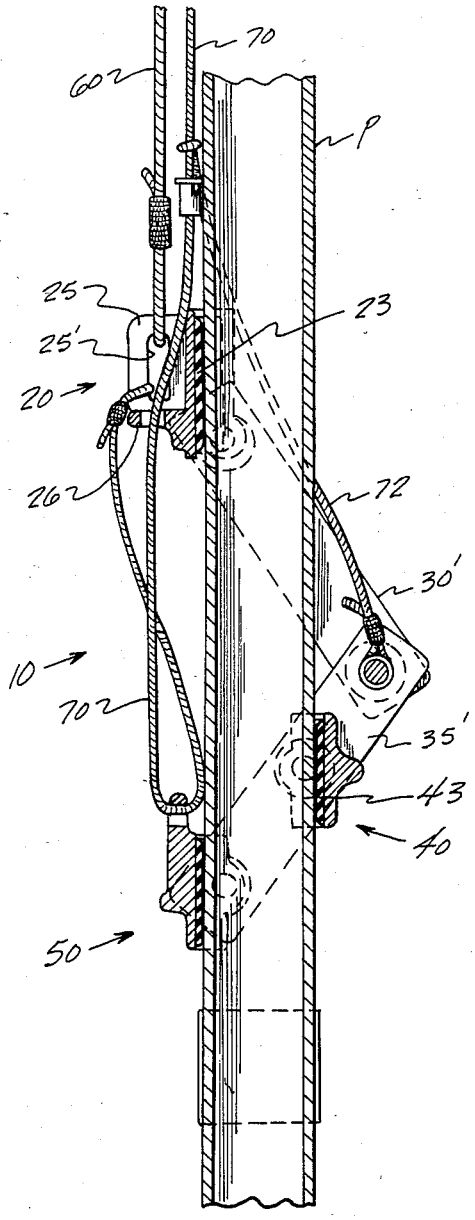
FIG. 5 is a vertical cross sectional view through the apparatus of the present invention as shown in FIG. 1, taken along a Line V—V.

In order to properly position apparatus 10 about a length of pipe P or the like a preferred embodiment includes a mechanism for releasing object engaging means 20, 40, and 50 from gripping engagement as desired. A releasing means 70, is preferably an elongated element such as a rope, wire, cable, or the like is secured at one end within eyelet 25' of first object engaging means 20, extends downwardly therefrom, passing through eyelet 57 on third object engaging means 50 and returns upwardly through offset eyelet 27 of first engaging means 20 and beyond. As illustrated in FIG. 1, release eyelets 57 and 27 are offset from a center line through apparatus 10. Referring to FIG. 5, it may be seen that an upward force applied to releasing means 70 will apply an upward force on object engaging means 50 and a downward force on object engaging means 20, causing arms 30, 30' and 35, 35' to pivot about connector rod 33. Such pivotal movement allows object engaging means 40, 50 and 20, due to their pivotal connections with their respective arm portions to loosen about provided, preferably in the form of an elongated element such as a rope, wire, cable, or the like. Releasing means 70 is secured at one end within eyelet 25' of first object engaging means 20, extends downwardly therefrom, passing through eyelet 57 of eyelet structure 56 on third object engaging means 50 and returns upwardly through offset eyelet 27 of first object engaging means and beyond. As illustrated in FIG. 1, release eyelets 57 and 27 are offset from a center line through apparatus 10. Referring to FIG. 5, it may be that an upward force applied to releasing means 70 will apply an upward force on object engaging means 50 and a downward force on object engaging means 20, causing arms 30, 30' and 30, 35' to pivot about connector rod 33 which allows object engaging means 40, 50 and 20, due to their pivotal connections with their respective arm portions to loosen about pipe P. Also, as illustrated in the Figures, in a preferred embodiment, a second release element 72 may be secured between connector rod 33 and a portion of primary release means 70 to further assist in the releasing function.

Figure 6:
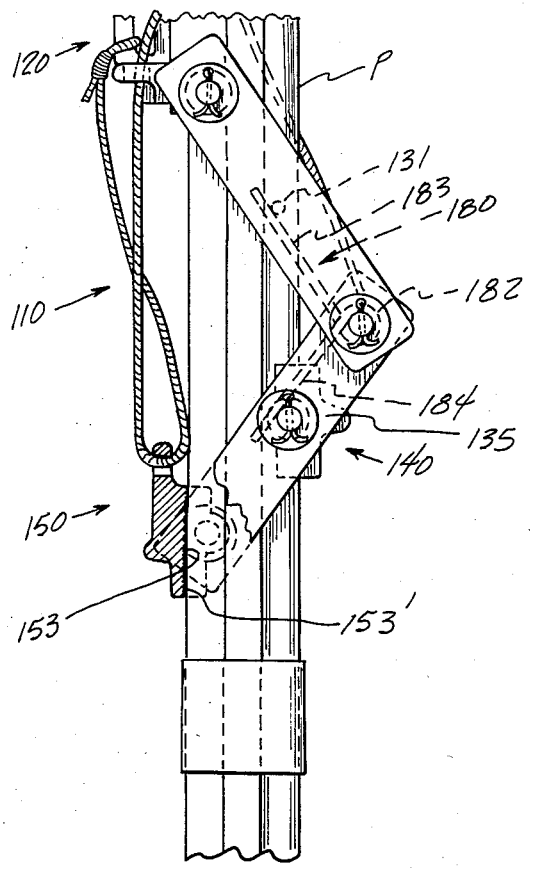
FIG. 6 is a side elevational view of the apparatus of the present invention, partially in cross section, illustrating a further embodiment of same.

FIG. 6 illustrates a further embodiment of the present invention. The handling apparatus generally 110 is constructed much like that shown in FIGS. 1 through 5 and a further complete description will not be set forth. Apparatus 110 is illustrated about a pipe P with object engaging means 120, 140 and 150 in gripping engagement. Object engaging means 150 is shown in cross section to illustrate inside wall 153 of flange 154 as having a ribbed or corrugated surface 153' of the type as mentioned hereinbefore. Improved gripping action on an object is achieved thereby. Also as illustrated in FIG. 6, a spring means generally 180 is shown partially in phantom behind arms 130, 135. Spring means 180 has a coil portion 182 positioned around connector rod 133 with arms 183 and 184 extending outwardly therefrom along arm 130, 135 respectively. Spring arm 183 resides under tension against a stop 131 on arm 130 while arm 184 is held under tension against a portion of object engaging means 140. Spring means 180 thus biases apparatus 110 in a gripping whereby during placement, or the like of apparatus 110 along a pipe, the releasing means must be employed to overcome the spring bias. Apparatus so equipped may be more precisely located, and of course remains in place when positioned even when no tension is applied to the lifting means.

In operation therefore, with the respective object engaging means 20, 40, and 50, properly located about an object to be lifted, such as a pipe P, and with force applied to the releasing means 70, apparatus 10 may be easily lowered about pipe P to a particular location where the gripping action is intended to occur. At this point, the force on the releasing means 70 is removed, whereby the respective object engaging means, due to their pivotal connections with their respective arm portions, come into initial engagement with the pipe P. Upon institution of force on lifting means 60, the gripping action occurs as described above and pipe P may be lifted from the wall. Also, if a spring means is included, some gripping action occurs upon removal of force on releasing means 70.

Apparatus of the present invention may be manufactured from any structural materials that have adequate strength for the particular type of object to be handled. Particularly, the object engaging means may be cast from various metals, may be molded of plastic, may be produced from individual elements united in an appropriate fashion as by weldments, so long as a requisite strength characteristics are present. The gripping surfaces as described with respect to the individual object engaging means may be any high friction material such as rubber, various polymers or the like which may be appropriately secured as by way of an adhesive to the inside wall of the respective object engaging means. Particular surface configurations, compositions and the like may be dictated by the specific object to be handled by the apparatus. Moreover, while the present embodiment has been described in respect to a pipe P which is cylindrical in nature, as mentioned above, any particular geometrically configured object may be lifted and/or handled by apparatus according to the present invention by tailoring the inside surface of the object engaging means to the particular geometry of the object to be handled. For example, for a rectangular pipe, duct, or conduit, an inside surface of the object engaging means could follow a like geometrical contour to ensure proper lifting engagement with same.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A lifting assembly comprising:

(a) first means for engagement with a portion of an object to be lifted;

(b) a first pair of arms pivotally secured at opposite sides of said first engagement means;

(c) a second pair of arms pivotally secured to said first pair of arms at an opposite end of same;

(d) second means for engagement with a further portion of said object along a side generally opposite said first means, said second means being pivotally secured between one of said pairs of arms intermediate the length of same;

(e) third means for engagement with a further portion of said object along the same general side engageable by said first engagement means; and (f) assembly lifting means secured to said first engagement means, whereby when force is applied to said lifting means, said first, second and third engagement means are maintained in holding engagement with said object.

2. An assembly as defined in claim 1 wherein said object is cylindrical in shape, and said first, second and third engagement means comprise hemi-cylindrical elements, said elements having an inner wall having a curvature that is compatible with an outer curvature of the object.

3. An assembly as defined in claim 1 wherein said first, second and third engagement means define an inside shape that is compatible with an outside shape of said object.

4. An assembly as defined in claim 3 wherein said first, second and third engagement means have connector rods secured to opposite sides of same and extending outwardly therefrom, said arms being pivotally secured about said rods.

5. An assembly as defined in claim 1 comprising further:

(a) assembly releasing means secured to said first engagement means extending downwardly to and about a portion of said third engagement means and returning upwardly beyond said first means and in association therewith, whereby upward force on said engagement releasing means will cause said engaging means to pivot about their connections with said arms, moving said first and third engagement means closer together and said second engagement means away from said object, whereby said first, second and third engagement means are out of holding engagement with said object.

6. An assembly as defined in claim 5 wherein said first and third engagement means define at least one eyelet about an outer surface of same, said releasing means passing from its point of securement at said first engagement means through said eyelet on said third means and then upwardly through said at least one eyelet on said first means.

7. Apparatus for lifting or handling a cylindrical object comprising:

(a) first object engaging means;

(b) second object engaging means operatively associated with said first object engaging means to reside on an opposite side of said object therefrom;

(c) third object engaging means operatively associated with said second engaging means to reside on a side of said object generally opposite therefrom;

(d) means secured to said first object engaging means for raising and lowering said apparatus whereby upon institution of an upward force, said object engagine means are biased into said object for secure gripping engagement with same; and (e) releasing means associated with said first and third object engaging means, whereby an upward force on said releasing means, will release said object engaging means from gripping engagement with said object.

8. Apparatus as defined in claim 7 wherein said object engaging means comprise a body, a flange secured to said body, said flange having an inside wall with respect to said object that has a contour of similar geometry to a portion of an outer contour of said object to be engaged.

9. Apparatus as defined in claim 8 wherein said inside walls of said flanges are provided with a friction surface thereon.

10. Apparatus as defined in claim 9 wherein said friction surface comprises a resilient pad secured to said inside wall.

11. Apparatus as defined in claim 7 wherein said object engagement means are operatively associated by arms pivotally secured thereto, a first pair of arms being pivotally associated with said first engagement means, a second pair of arms pivotally associated with said first pair of arms, said second pair of arms having said second and third engagement means pivotally secured therebetween.

12. Apparatus as defined in claim 7 wherein said object engaging means have an inside surface that defines a contour similar to the contour of an outer surface of an object to be handled.

* * * * *